US005311638A

United States Patent [19]

Furcron et al.

[11] Patent Number: 5,311,638

[45] Date of Patent: May 17, 1994

[54] CLEANING DEVICE

[75] Inventors: Kent J. Furcron, Bristol; John W. Walch, Abingdon, both of Va.

[73] Assignee: The Regina Company, Atlanta, Ga.

[21] Appl. No.: 86,752

[22] Filed: Jul. 2, 1993

Related U.S. Application Data

[63] Continuation of Ser. No. 730,203, Jul. 15, 1991, abandoned.

[51] Int. Cl.[5] ..... A47L 9/00

[52] U.S. Cl. ..... 15/321; 15/322; 15/328

[58] Field of Search ..... 15/321, 322, 328, 320

[56] References Cited

U.S. PATENT DOCUMENTS

| | | | |
|---|---|---|---|
| D. 50,946 | 6/1917 | Kirby . | |
| D. 81,779 | 8/1930 | Finnell . | |
| D. 157,774 | 3/1950 | Minerley | D9/2 |
| D. 188,309 | 12/1960 | Gantz | D9/2 |
| D. 188,411 | 7/1960 | Gantz | D9/2 |
| D. 189,124 | 11/1960 | Kelnhofer | D9/2 |
| D. 197,459 | 2/1964 | Jepson et al. | D9/2 |
| D. 208,627 | 9/1967 | Bonzer | D9/2 |
| D. 211,396 | 6/1968 | Hori | D49/14 |
| D. 211,824 | 7/1968 | Burgoon | D49/11 |
| D. 242,211 | 11/1976 | Parise | D15/63 |
| D. 242,212 | 11/1976 | Parise et al. | D15/63 |
| D. 252,151 | 6/1979 | Webb | D15/48 |
| D. 252,880 | 9/1979 | Dummermuth | D15/48 |
| D. 252,881 | 9/1979 | Dummermuth | D15/48 |
| D. 253,252 | 11/1979 | Tack | D7/164 |
| D. 255,359 | 6/1980 | Bartlett | D15/63 |
| D. 264,139 | 4/1982 | Pearman, Jr. | D32/33 |
| D. 277,325 | 1/1985 | Hug | D32/22 |
| D. 286,334 | 10/1986 | Strohmeyer | D32/22 |
| D. 286,335 | 10/1986 | Strohmeyer | D32/22 |
| D. 286,456 | 10/1986 | Groth | D32/31 |
| D. 287,894 | 1/1987 | Walkins et al. | D32/22 |
| D. 288,016 | 1/1987 | Watkins et al. | D32/22 |
| D. 289,336 | 4/1987 | Fitzwater | D32/22 |
| D. 289,337 | 4/1987 | Fitzwater | D32/22 |
| D. 290,892 | 7/1987 | Slany | D32/15 |
| D. 293,729 | 1/1988 | Soeffker et al. | D32/22 |
| D. 294,988 | 3/1988 | Goodrich | D32/34 |
| D. 296,372 | 6/1988 | Toney et al. | D32/32 |
| D. 298,673 | 11/1988 | Slaney et al. | D32/18 |
| D. 303,171 | 8/1989 | Goodrich et al. | D32/21 |
| D. 305,269 | 12/1989 | Dyson | D32/22 |
| D. 306,087 | 2/1990 | Woodhall et al. | D32/22 |
| D. 313,879 | 1/1991 | Ito | D32/22 |
| D. 314,260 | 1/1991 | Lee | D32/22 |
| D. 315,043 | 2/1991 | Hayden | D32/34 |
| 25,939 | 12/1865 | Krammes | 15/320 |
| 373,825 | 11/1887 | Gleich et al. . | |
| 729,423 | 5/1903 | Scheiber et al. . | |

(List continued on next page.)

FOREIGN PATENT DOCUMENTS 0404278 12/1990 European Pat. Off. .
0404279 12/1990 European Pat. Off. .

OTHER PUBLICATIONS

Bissell Carpet Machine Plus Owner's Manual; Bissell Inc.; 1990; 1, 3–4, 6, 8–9.

SteamTeam Owner's Manual; Shop-Vac Corporation; 1989; 1, 3–4.

*Primary Examiner*—Chris K. Moore
*Attorney, Agent, or Firm*—Jones & Askew

[57] ABSTRACT

An improved cleaning system of the type which applies a cleaning fluid to a surface to be cleaned and then vacuums the dirty cleaning fluid from said surface is provided. The system includes a cleaning fluid pump for delivering pressurized cleaning fluid to spray nozzles attached to either a floor nozzle or a hand tool. Both the floor nozzle and the hand tool are connected to the suction and cleaning fluid connectors of the main cleaner unit by a one-step connection which connects both fluid and suction lines in a single motion. The hand tool, which is attached to the main unit by a hose assembly, has its own pinch valve for controlling the application of cleaning fluid to the surface to be cleaned. When the hand tool is being used the trigger which actuates the pump may be locked in the "on" position.

13 Claims, 10 Drawing Sheets

U.S. PATENT DOCUMENTS

| | | | |
|---|---|---|---|
| 866,715 | 10/1907 | Skinner . | |
| 919,606 | 4/1909 | Locke et al. . | |
| 928,982 | 7/1909 | Kindel . | |
| 945,879 | 1/1910 | Wardwell . | |
| 983,971 | 2/1911 | Baker . | |
| 989,503 | 4/1911 | Hildebrand . | |
| 1,088,880 | 3/1914 | Clements . | |
| 1,114,592 | 10/1914 | De Witt . | |
| 1,145,555 | 7/1915 | Clements . | |
| 1,175,402 | 3/1916 | Baylis . | |
| 1,283,499 | 11/1923 | Gray . | |
| 1,440,759 | 1/1923 | Wright . | |
| 1,474,875 | 11/1923 | Adams . | |
| 1,533,919 | 4/1923 | Keefer . | |
| 1,536,230 | 5/1925 | McCue . | |
| 1,562,971 | 11/1925 | Kershaw et al. . | |
| 1,613,250 | 1/1927 | Spielman . | |
| 1,856,031 | 4/1932 | Riebel, Jr. . | |
| 1,876,988 | 9/1932 | Lormor . | |
| 1,954,863 | 4/1934 | Coles et al. | 299/121 |
| 1,964,269 | 6/1934 | Munz | 299/18 |
| 1,982,345 | 11/1934 | Kirby | 15/2 |
| 1,994,871 | 3/1935 | Replogle | 15/138 |
| 2,002,637 | 5/1935 | Leathers | 15/158 |
| 2,003,847 | 6/1935 | Woods | 15/269 |
| 2,146,252 | 2/1939 | Ell | 285/169 |
| 2,207,582 | 7/1940 | Dunbar | 15/158 |
| 2,216,275 | 10/1940 | Kroenlein | 15/155 |
| 2,222,018 | 11/1940 | Bruce | 285/174 |
| 2,531,370 | 11/1950 | Thompson | 15/321 |
| 2,570,347 | 10/1951 | Humphrey | 285/97.5 |
| 2,635,276 | 4/1953 | Norris | 15/320 |
| 2,652,583 | 9/1953 | Tomanica | 15/394 |
| 2,706,826 | 4/1955 | Brock | 15/368 |
| 2,721,764 | 10/1955 | Wilson, Jr. | 299/106 |
| 2,767,022 | 10/1956 | Kennard et al. | 299/84 |
| 2,793,385 | 5/1957 | Ortega | 15/367 |
| 2,815,984 | 12/1957 | Llopis | 299/88 |
| 2,832,612 | 4/1958 | Coutts | 285/7 |
| 2,912,261 | 11/1959 | Meyerhoefer | 285/7 |
| 2,918,220 | 12/1959 | Crow | 239/231 |
| 2,941,822 | 6/1960 | Moecker | 285/7 |
| 2,946,071 | 7/1960 | Nilsson | 15/39 |
| 2,974,345 | 3/1961 | Krammes | 15/328 |
| 2,986,764 | 6/1961 | Krammes | 15/320 |
| 2,990,979 | 7/1961 | Harrison et al. | 222/482 |
| 2,995,674 | 9/1961 | Krammes | 183/93 |
| 2,998,934 | 9/1961 | Broughton | 239/521 |
| 3,002,214 | 10/1961 | Krammes | 15/320 |
| 3,014,067 | 3/1962 | Bates | 15/320 |
| 3,060,484 | 10/1962 | Krammes | 15/320 |
| 3,094,152 | 6/1963 | Kenney et al. | 141/19 |
| 3,105,745 | 10/1963 | Vieli | 23/252 |
| 3,168,341 | 2/1965 | Beaudet | 287/119 |
| 3,184,780 | 5/1965 | Hageman | 15/547 |
| 3,188,669 | 6/1965 | Beardslee | 15/98 |
| 3,212,795 | 10/1965 | Helm et al. | 285/7 |
| 3,250,551 | 5/1966 | Draudt | 285/7 |
| 3,273,194 | 9/1966 | Jepson et al. | 15/323 |
| 3,278,974 | 10/1966 | Nighswander | 15/510 |
| 3,289,232 | 12/1966 | Beach | 15/29 |
| 3,316,389 | 4/1967 | Skinner | 200/61.58 |
| 3,347,575 | 10/1967 | Morris | 285/7 |
| 3,432,194 | 3/1969 | Garnier | 287/119 |
| 3,433,415 | 3/1969 | Enssle | 239/126 |
| 3,433,417 | 3/1969 | Poppitz | 239/304 |
| 3,438,607 | 4/1969 | Williams et al. | 251/9 |
| 3,538,535 | 11/1970 | Ginsburgh et al. | 15/321 |
| 3,562,844 | 2/1971 | Thompson et al. | 15/302 |
| 3,588,149 | 6/1971 | Delmer, Sr. | 285/110 |
| 3,614,705 | 10/1971 | Descarries et al. | 339/8 |
| 3,639,939 | 2/1972 | Crener et al. | 15/320 |
| 3,689,117 | 9/1972 | Hules | 300/21 |
| 3,690,244 | 9/1972 | Kallel et al. | 98/40 |
| 3,700,002 | 10/1972 | Christie | 137/565 |
| 3,705,437 | 12/1972 | Rukavina et al. | 15/302 |
| 3,720,977 | 3/1973 | Brycki | 15/321 |
| 3,742,546 | 7/1973 | Crener et al. | 15/50 |
| 3,748,050 | 7/1973 | Poppitz | 401/289 |
| 3,775,053 | 11/1973 | Wisdom | 8/142 |
| 3,783,473 | 1/1974 | Engquist | 15/322 |
| 3,812,552 | 5/1974 | Blackmon | 15/321 |
| 3,818,538 | 6/1974 | Kraft | 15/322 |
| 3,828,390 | 8/1974 | Cater | 15/321 |
| 3,829,019 | 8/1974 | Petsch | 239/251 |
| 3,832,069 | 8/1974 | Petsch | 401/289 |
| 3,848,291 | 11/1974 | Morse | 15/322 |
| 3,866,264 | 2/1975 | Engquist | 15/421 |
| 3,874,024 | 4/1975 | Ford | 15/339 |
| 3,885,267 | 5/1975 | Maurer et al. | 15/339 |
| 3,896,521 | 7/1975 | Parise | 15/231 |
| 3,939,527 | 2/1976 | Jones | 15/353 |
| 3,950,014 | 4/1976 | Doubleday | 285/7 |
| 3,958,298 | 5/1976 | Cannan | 15/322 |
| 3,959,844 | 6/1976 | Cyphert | 15/320 |
| 3,960,224 | 6/1976 | Silvers | 177/47 |
| 3,985,167 | 10/1976 | Roque | 141/392 |
| 4,009,728 | 3/1977 | Parise | 137/594 |
| 4,018,493 | 4/1977 | Lyman et al. | 339/15 |
| 4,073,030 | 2/1978 | Albishausen | 15/322 |
| 4,074,387 | 2/1978 | Arato et al. | 15/322 |
| 4,075,733 | 2/1978 | Parise et al. | 15/322 |

(List continued on next page.)

U.S. PATENT DOCUMENTS

| | | | |
|---|---|---|---|
| 4,083,077 | 4/1978 | Knight et al. | 15/321 |
| 4,114,229 | 9/1978 | Jones et al. | 15/320 |
| 4,114,927 | 9/1978 | Butcher | 285/7 |
| 4,116,476 | 9/1978 | Porter et al. | 285/137 |
| 4,137,600 | 2/1979 | Albishausen | 15/321 |
| 4,153,968 | 5/1979 | Perkins | 15/321 |
| 4,156,952 | 6/1979 | Lynch, Jr. | 15/320 |
| 4,159,554 | 7/1979 | Knight et al. | 15/321 |
| 4,164,055 | 8/1979 | Townsend | 15/321 |
| 4,170,805 | 10/1979 | Kumagai | 15/321 |
| 4,194,262 | 5/1980 | Finley et al. | 15/214 |
| 4,202,072 | 5/1980 | Gonzales | 15/302 |
| 4,216,563 | 8/1980 | Cyphert | 15/321 |
| 4,262,876 | 4/1981 | Willatt | 251/9 |
| 4,266,317 | 5/1981 | Duda | 15/322 |
| 4,270,238 | 8/1981 | Shallenberg | 15/321 |
| 4,307,484 | 12/1981 | Williams | 15/321 |
| 4,329,756 | 5/1982 | Chicoine et al. | 15/321 |
| 4,333,203 | 6/1982 | Yonkers | 15/321 |
| 4,357,177 | 11/1982 | Knox | 134/21 |
| 4,365,378 | 12/1982 | Springer | 15/98 |
| 4,393,536 | 7/1983 | Tapp | 15/327 |
| 4,413,372 | 11/1983 | Berfield | 15/414 |
| 4,433,551 | 2/1984 | Parisi | 15/321 |
| 4,441,229 | 4/1984 | Monson | 15/322 |
| 4,458,377 | 7/1984 | Frohbieter | 15/328 X |
| 4,472,855 | 9/1984 | Murphy et al. | 15/323 |
| 4,475,265 | 10/1984 | Berfield | 15/414 |
| 4,485,518 | 12/1984 | Kasper | 15/322 |
| 4,494,270 | 1/1985 | Ritzau et al. | 15/377 |
| 4,517,404 | 5/1985 | Hughes et al. | 174/47 |
| 4,531,257 | 7/1985 | Passien | 15/321 |
| 4,557,013 | 12/1985 | Belmont | 15/401 |
| 4,558,484 | 12/1985 | Groth | 15/320 |
| 4,559,665 | 12/1985 | Fitzwater | 15/339 |
| 4,559,666 | 12/1985 | Duncan et al. | 15/353 |
| 4,559,666 | 12/1985 | Fitzwater | 15/415 |
| 4,559,667 | 12/1985 | Fitzwater | 15/339 X |
| 4,592,111 | 6/1986 | Berfield | 15/371 |
| 4,596,061 | 6/1986 | Henning | 15/322 |
| 4,616,378 | 10/1986 | Berfield et al. | 15/353 |
| 4,621,634 | 11/1986 | Nowacki et al. | 128/204.18 |
| 4,638,526 | 1/1987 | Murata et al. | 15/367 |
| 4,638,527 | 1/1987 | Fleischhauer | 15/371 |
| 4,667,924 | 5/1987 | Speidel | 251/9 |
| 4,704,765 | 11/1987 | Ataka | 15/323 |
| 4,720,891 | 1/1988 | Rennecker et al. | 15/371 |
| 4,721,331 | 1/1988 | Lemelshtrich | 285/305 |
| 4,754,771 | 7/1988 | Tangherlini | 15/102 |
| 4,758,023 | 7/1988 | Vermillion | 285/7 |
| 4,780,992 | 11/1988 | McKervey | 51/180 |
| 4,788,738 | 12/1988 | Monson et al. | 15/320 |
| 4,793,646 | 12/1988 | Michaud, Jr. | 294/19 |
| 4,800,613 | 1/1989 | Blase et al. | 15/321 |
| 4,809,396 | 3/1989 | Houser | 15/320 |
| 4,809,397 | 3/1989 | Jacobs et al. | 15/320 |
| 4,826,539 | 5/1989 | Harpold | 134/10 |
| 4,827,562 | 5/1989 | Blase et al. | 15/353 |
| 4,833,752 | 5/1989 | Merrick | 15/322 |
| 4,845,802 | 7/1989 | Miller et al. | 15/321 |
| 4,847,943 | 7/1989 | Blase et al. | 15/352 |
| 4,862,551 | 9/1989 | Martinez et al. | 15/321 |
| 4,864,680 | 9/1989 | Blase et al. | 15/321 |
| 4,887,330 | 12/1989 | Woodhall et al. | 15/322 |
| 4,893,375 | 1/1990 | Girman et al. | 15/328 X |
| 4,910,828 | 3/1990 | Blase et al. | 15/321 |
| 4,915,640 | 4/1990 | Hayden | 439/191 |
| 4,920,244 | 4/1990 | Gundlach | 200/321 |
| 4,922,572 | 5/1990 | Kohl et al. | 15/320 |
| 4,930,178 | 6/1990 | Monson et al. | 15/320 |
| 4,938,421 | 7/1990 | Berfield et al. | 239/309 |
| 4,944,485 | 7/1990 | Daoud et al. | 251/9 |
| 4,955,104 | 9/1990 | Miller | 15/322 |
| 4,961,244 | 10/1990 | Stanfield et al. | 15/321 |
| 4,980,945 | 1/1991 | Bewley | 15/339 |
| 4,984,328 | 1/1991 | Berfield | 15/322 |
| 4,993,457 | 2/1991 | Berfield | 137/899 |

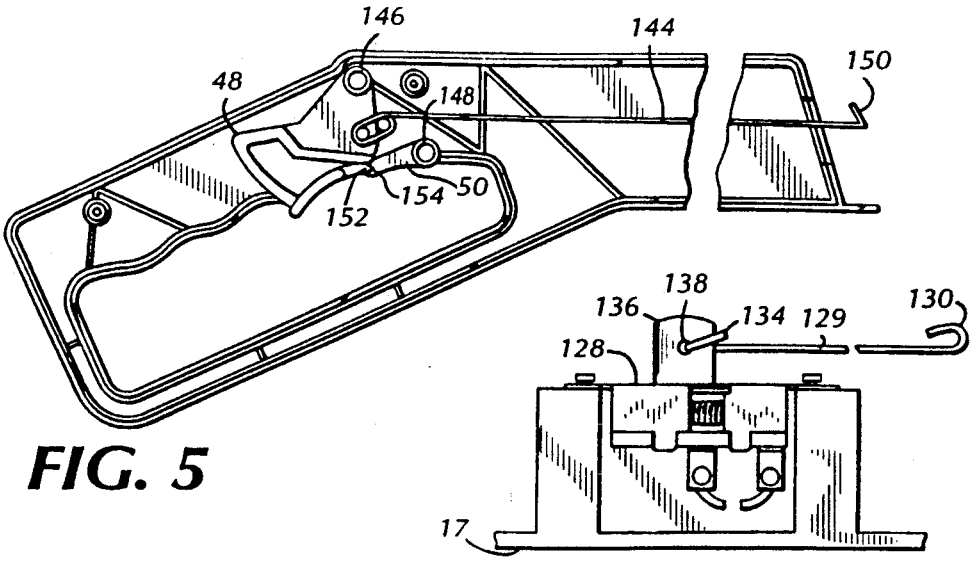
FIG. 5
FIG. 4A
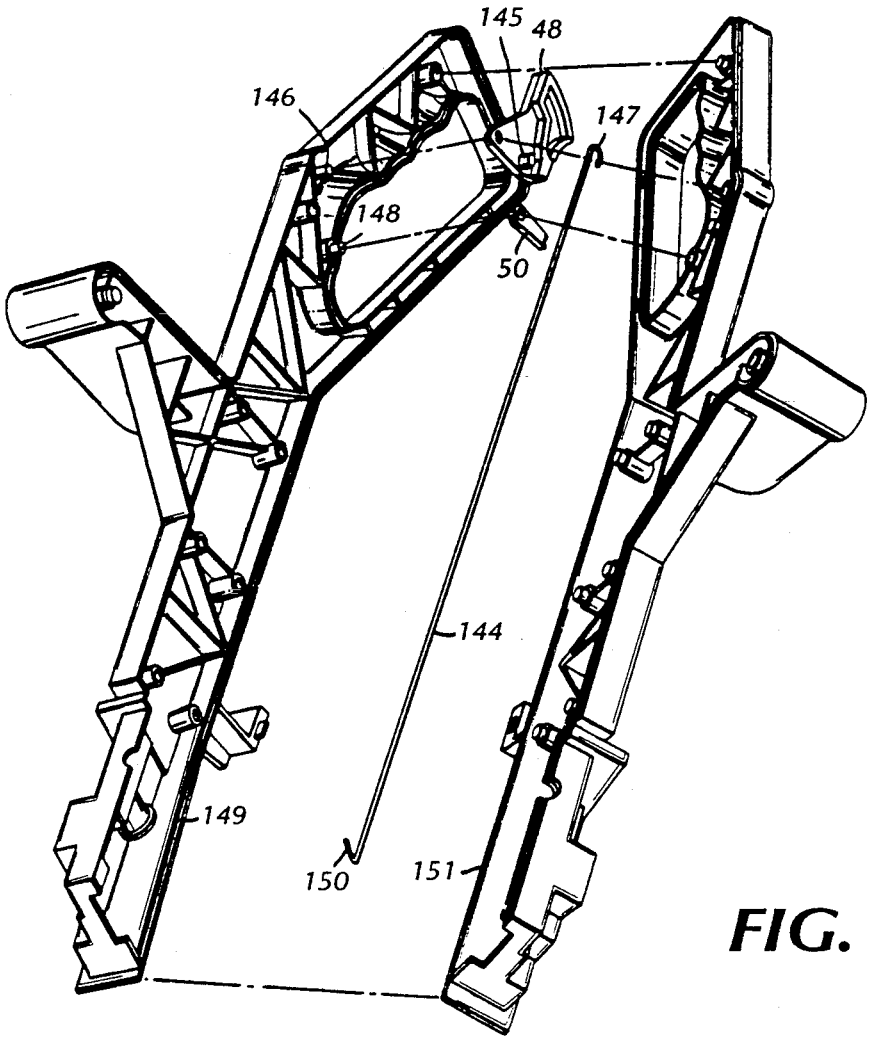
FIG. 5A

CLEANING DEVICE

This is a continuation of application Ser. No. 07/730,203, filed Jul. 15, 1991.

BACKGROUND OF THE INVENTION

The present invention relates to cleaning devices, and particularly cleaning devices which apply a cleaning solution to a surface to be cleaned and then use a source of suction to remove the cleaning solution, and any dirt mixed therein, from the surface to be cleaned.

Commonly assigned U.S. Pat. No. 4,558,484, the entire disclosure of which is hereby incorporated by reference, describes a cleaning device having a main housing, a suction nozzle at the lower end of the housing, a handle at the upper end of the housing and a pair of wheels attached near the lower end of the housing by means of struts. A reservoir of cleaning fluid detachably connects to a port on the main housing. A pair of tanks are removably mounted to the lower end of the housing. One of the tanks includes a supply of clean water; the other tank receives the dirty mixture of water and cleaning fluid that is vacuumed from the surface being cleaned.

In the cleaning device described in above-incorporated U.S. Pat. No. 4,558,484, a blower which provides the suction is located in the main housing, near its upper end. Directly above the blower is an electric motor which powers the blower. Beneath the blower is an air/liquid separator which separates the air from the mixture of air and dirty cleaning solution. The dirty solution passes by a conduit into the dirty water reservoir.

In the cleaning device described in above-incorporated U.S. Pat. No. 4,558,484, positive pressure from the blower is directed into the cleaning fluid bottle and clean water tank through inlet openings in the bottle and tank. This forces cleaning fluid and water out of outlets in the bottle and tank, respectively into separate conduits. After the cleaning fluid is mixed with the water, the mixed solution passes through a flexible conduit to a manifold on the underside of the main housing. The air exhausted by the blower is also directed into the manifold, so that the air being exhausted draws the water and cleaning fluid mixture out of the manifold and onto the surface to be cleaned. A pinch valve mechanism operated by a trigger on the handle is spring biased to crush the flexible conduit leading to the manifold to allow the user to control the application of the cleaning fluid/water mixture to the surface to be cleaned with the trigger.

While the cleaner described in above-incorporated U.S. Pat. No. 4,558,484 is versatile and effective for cleaning carpets and floors, it is not as well-suited for above-the-floor cleaning (i.e., cleaning upholstery, draperies, etc.) as the cleaner of the present invention. And, although some cleaners do exist which can perform above-the-floor cleaning by spraying a cleaning fluid on a surface and then vacuuming up the fluid, such systems have been bulky and inconvenient to use, and have usually been expensive to manufacture.

Accordingly, there is a need for an inexpensive, mobile cleaner which can spray a cleaning fluid on both floor and above-the-floor surfaces to be cleaned, and then vacuum the surface to remove the cleaning fluid and dirt.

SUMMARY OF THE INVENTION

It is an object of this invention to provide an inexpensive, mobile cleaner which can effectively spray a cleaning fluid on both floor and above-the-floor surfaces to be cleaned, and then vacuum the surface to remove the cleaning fluid and dirt.

It is also an object of this invention to provide an inexpensive and reliable upholstery or hand tool for a cleaner, wherein the upholstery tool includes a means for spraying a cleaning fluid on a surface to be cleaned, valve means for controlling the means for spraying, wherein the hand tool can be connected to a source of pressurized cleaning fluid and a source of suction air for vacuuming the mixture of dirt and cleaning fluid from the surface to be cleaned.

It is a further object of this invention to provide a one-step connection for coupling two parallel fluid lines.

It is another object of this invention to provide a detachable squeegee which can be easily clipped onto and removed from a suction nozzle.

In accordance with this invention, a cleaner for controllably spraying a cleaning fluid on both floor and above-the-floor surfaces to be cleaned, and then vacuuming the surface, is provided. The cleaner includes a cleaning fluid pump for drawing cleaning fluid from a cleaning fluid supply means. The output of the pump is attached to a nipple connector extending beside and parallel to the suction line connector of the cleaner. A floor nozzle can be detachably connected to the nipple connector and suction line connector, and a trigger means can be used to spray cleaning fluid on the surface to be cleaned through a spray nozzle attached to the floor nozzle and connected to the nipple connector. The floor nozzle can be replaced by a hand tool which also connects to the nipple connector and the suction line connector. When the hand tool is used, a trigger lock is provided to lock the trigger means in a position to keep the pump on, and the application of cleaning fluid is controlled by a pinch valve mechanism in the hand tool.

Also provided is a hand or upholstery tool for use with a cleaner which applies a cleaning fluid to a surface to be cleaned and then vacuums up the cleaning fluid. The hand tool comprises a unitary housing having a cylindrical main body, a rear nozzle wall, a nozzle base, and a pair of downwardly extending, parallel side walls. A face plate comprising a front nozzle wall and two nozzle side walls is adhered to the rear nozzle wall and the nozzle base to form the nozzle. A trigger mechanism and a spray nozzle attach to the underside of the hand tool between the parallel side walls. The trigger mechanism controls a hammer which is spring biased to crush a flexible conduit supplying cleaning fluid against the main body of the hand tool unless the rear end of the trigger is drawn toward the main body of the hand tool. The flexible conduit carries pressurized cleaning fluid to the spray nozzle.

A coupling arrangement for detachably coupling both suction and cleaning fluid lines from a hose assembly to a cleaning appliance is also provided. A tubular suction line coupling part and a cleaning fluid nipple on the cleaning appliance are coupled to a hose assembly by a coupling collar which fits over the suction line coupling part, with the cleaning fluid nipple fitting in a bore in a projection on the coupling collar.

A squeegee which can be clipped onto and easily removed from a floor nozzle is also provided. The squeegee mounting clip positions the squeegee blade low enough so as to raise the floor nozzle brush off the floor.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which:

FIG. 4A is a view of the pump switch assembly employed in one embodiment of the present invention;

FIG. 5 is a cross-sectional view of a handle of a cleaner in accordance with the present invention;

FIG. 5A is an exploded view of the handle, trigger and trigger lock assembly of a cleaner in accordance with the present invention;

DETAILED DESCRIPTION OF THE INVENTION

Figure 1:
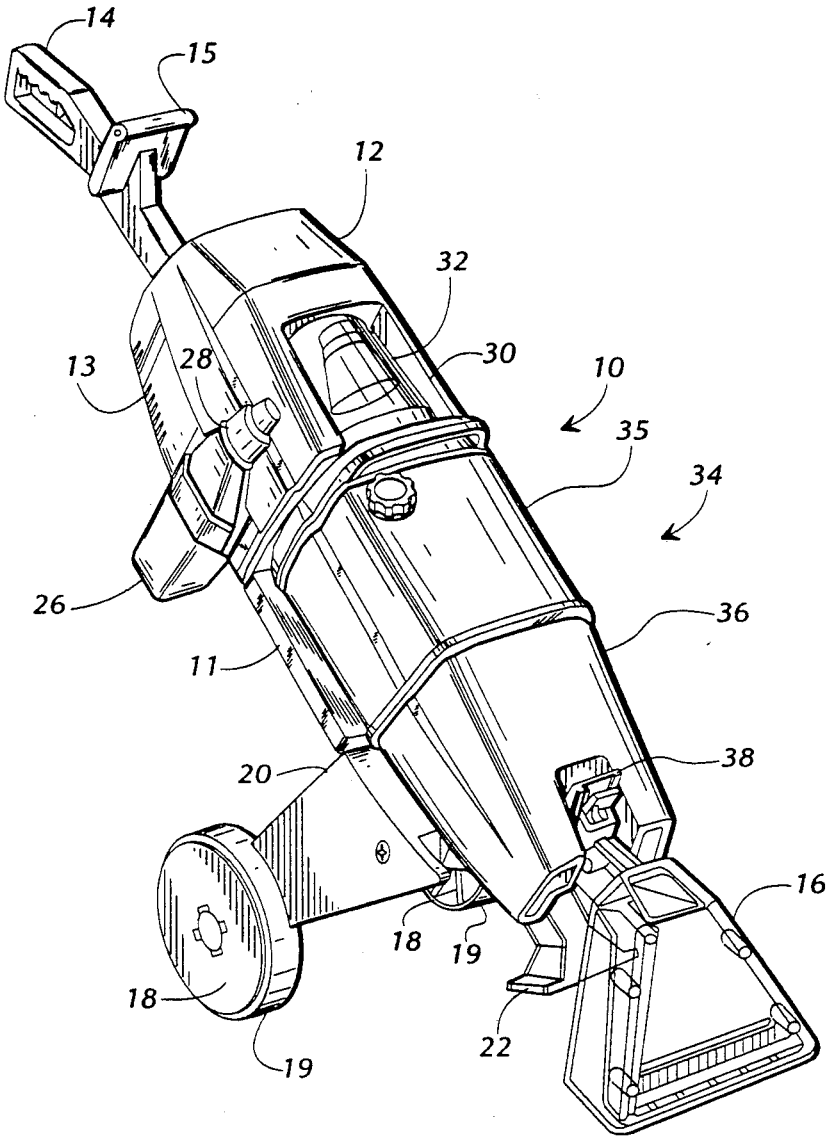
FIG. 1 is a perspective view of the main unit of a cleaner in accordance with the present invention.
Figure 2:
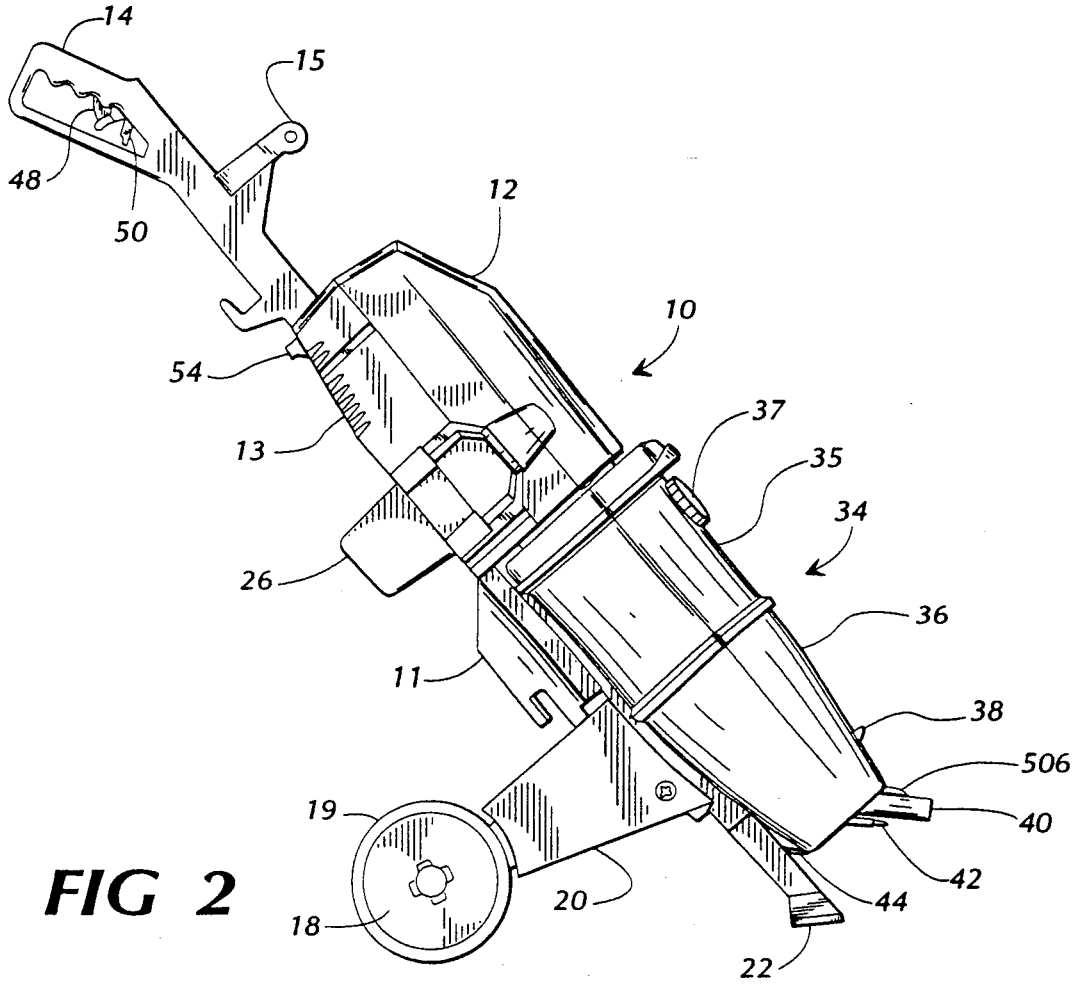
FIG. 2 is side view of the main unit of a cleaner in accordance with the present invention, with the floor nozzle removed.

The present invention is an improved cleaner of the type shown and described in above-incorporated U.S. Pat. No. 4,558,484. As shown in FIGS. 1 and 2 of the present application, main cleaner unit 10 includes an upper housing 12, a rear housing 13 and a rear cover 11. Handle 14, and rear housing 13 are attached to main frame 17 (shown in FIGS. 3 and 4). Upper housing 12 is attached to rear housing 13. Leverage-assist pad 15 is an integral part of handle 14.

A pair of struts 20 (only one of which is shown in FIGS. 1 and 2) attaches wheels 18 to main frame 17. Wheels 18 may optionally include rubber tires 19. Floor nozzle 16 attaches to main unit suction connector 40. Frame stand 22 attaches to the underside of the main frame 17. Frame stand 22 is raised slightly off the floor when floor nozzle 16 is attached to the main unit, as shown in FIG. 1.

Tank unit 34 includes clean water tank 35 and dirty solution tank 36. Water is added to clean water tank 35 in the opening normally covered by tank cap 37. Tank unit 34, which can be removed to fill clean water tank 35 or empty dirty solution tank 36, is held in position by cam latch 38 as described in above-incorporated U.S. Pat. No. 4,558,484.

Cleaning fluid bottle 26, which contains concentrated cleaning fluid, is removably attached to cleaner 10 at cleaning fluid port 28. The docking port connection with cleaning fluid bottle 26 is described in above-incorporated U.S. Pat. No. 4,558,484.

Upper housing 12 may have a window 30 such as is shown in FIG. 1 so that air/liquid separator 32 can be seen through window 30.

FIG. 2 is a side view of cleaner 10, but with floor nozzle 16 removed. As shown in FIG. 2, cleaning solution nipple connector 42 is located directly under main housing suction connector 40. Conduit 44 provides pressurized cleaning solution to nipple connector 42 from pump 104 (not shown in FIG. 2) which is located between main frame 17 and rear cover 11.

FIG. 2 also shows trigger 48 in handle 14. Directly in front of trigger 48 is trigger lock 50. Power switch 54 controls power to the cleaner 10. Power switch 54 can be a two-position (on/off) switch, or it may have more positions if the motor for the blower is to be operated at more than one speed. A power line cord (not shown) enters rear housing 13 on the side opposite power switch 54.

FIG. 2 also shows cleaner 10 standing on wheels 18 and frame stand 22, as floor nozzle 16 has been removed.

Figure 3:
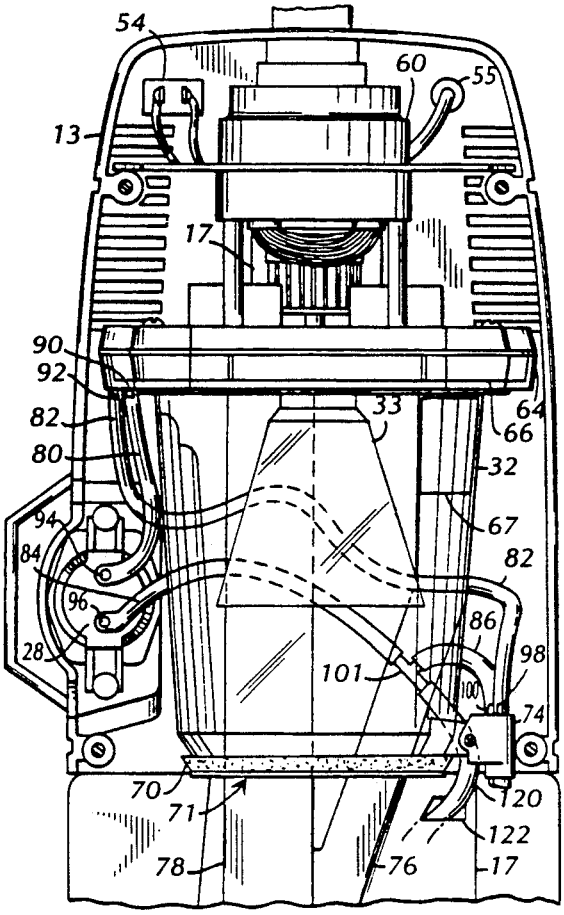
FIG. 3 is a front view of the upper portion of a cleaner of the type of the present invention, with the upper housing removed.

FIG. 3 shows the motor 60, blower 66, air/liquid separator 32 and tank block 74 in rear housing 13. The motor 60, which may have one or more speeds, is powered by power line cord 55 via switch 54. The motor shaft drives blower 66 in blower chamber 64.

Air/liquid separator 32 is preferably transparent, as shown in FIG. 3. The mixture of dirty air and liquid from the suction nozzle travels through suction conduit 76 and enters air/liquid separator 32 through an opening 67 in the back of separator 32. As described and shown more fully in above-incorporated U.S. Pat. No. 4,558,484, air in separator 32 is drawn up through the open bottom of conical shroud 33 and into blower chamber 64 through an opening at the top of conical shroud 33. From blower chamber 64, the air is exhausted via exhaust conduit 78, which leads down to the bottom of the cleaner housing, where the air is exhausted from the cleaner 10. Liquid and dirt mixed therein entering separator 32 are drawn by gravity down to the open end 71 of separator 32. Tank unit 34 (not shown in FIG. 3) sealingly connects to the open end 71 of separator 32, with gasket 70 sealing the connection.

The motor 60, blower chamber 64, air/liquid separator 32, and tank block 74, which are mounted to main frame 17 by conventional means, are not discussed in great detail here as they are known to those skilled in the art and as they are described in above-incorporated U.S. Pat. No. 4,558,484.

FIG. 3 also shows the upper end of the cleaning fluid port 28, cleaning fluid bottle bleed connector 94 and cleaning fluid line connector 96. Thin conduit 80 connects cleaning fluid bottle bleed connector 94 to a first connector 90 on the lower side of blower chamber 64. Similarly, a second connector 92 on blower chamber 64 is connected by thin conduit 82 to water tank bleed connector 98 on tank block 74. The thin conduits preferably comprise PVC tubing, the ends of which are stretched tightly over the connectors to seal the connection.

Tank block 74, which is attached to separator 32, also has a water line connector 100, which is located directly behind water tank bleed connector 90 as shown in FIG. 3. Water conduit 86 connects water line connector 100 to a first connector 103 on "T" connector 101, which is shown through transparent separator 32 in FIG. 3. "T" connector 101 is shown more clearly in FIG. 20. Similarly, cleaning fluid conduit 84 connects cleaning fluid line connector 96 to a second connector 105 on the "T" connector 101 shown in detail in FIG. 20. Water conduit 86 and cleaning fluid conduit 84 are preferably transparent PVC tubing having respective inner diameters of about 0.187 and 0.156 inches, respectively. The three passageways in "T" connector 101 all have the same inner diameters, preferably about 0.120 inches.

While the embodiment of the invention described herein employs "T" connector 101 as a mixing manifold, it will be understood this is but one of a multitude of manifolds which can be used for this purpose.

While a number of different cleaning fluids may be employed in the present invention, the preferred cleaning fluids are Regina® STEEMER® Carpet Shampoo and Regina® STEEMER® Upholstery Shampoo.

Figure 4:
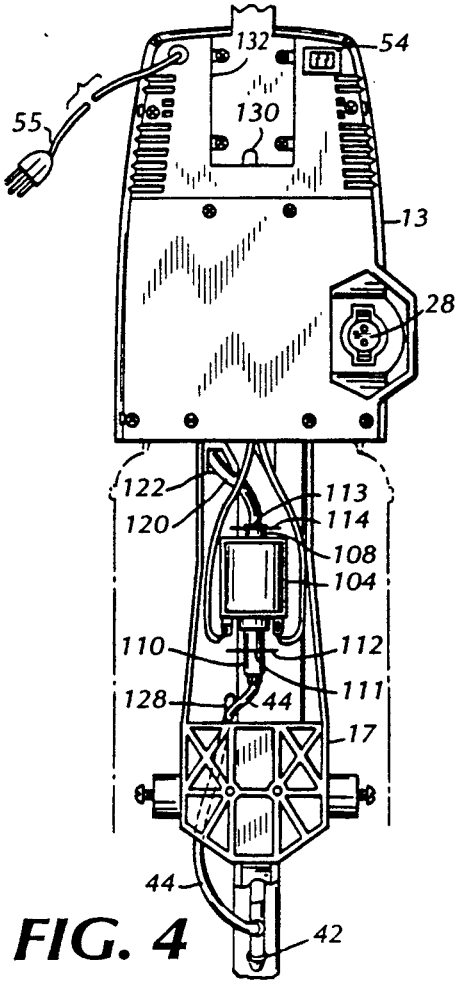
FIG. 4 is a rear view of the lower portion of a cleaner in accordance with the present invention, with the rear cover removed.

FIG. 4 shows cleaning solution pump 104, which is preferably a 120V electric oscillating pump, such as Eaton Controls Mod. No. CP5. Pump 104, which includes input connector 108 and output connector 110, is mounted on two mounting brackets 112 and 114, each of which includes a semi-circular opening. Input connector 108 and output connector 110 have grooves 111 and 113, respectively, which fit into the semicircular-thin openings of mounting brackets 112 and 114. The inside of rear cover 11 also includes a similar pair of mounting brackets (not shown) having semicircular-openings to hold pump 104 in place when the rear cover is attached to main frame 17.

Figure 20:
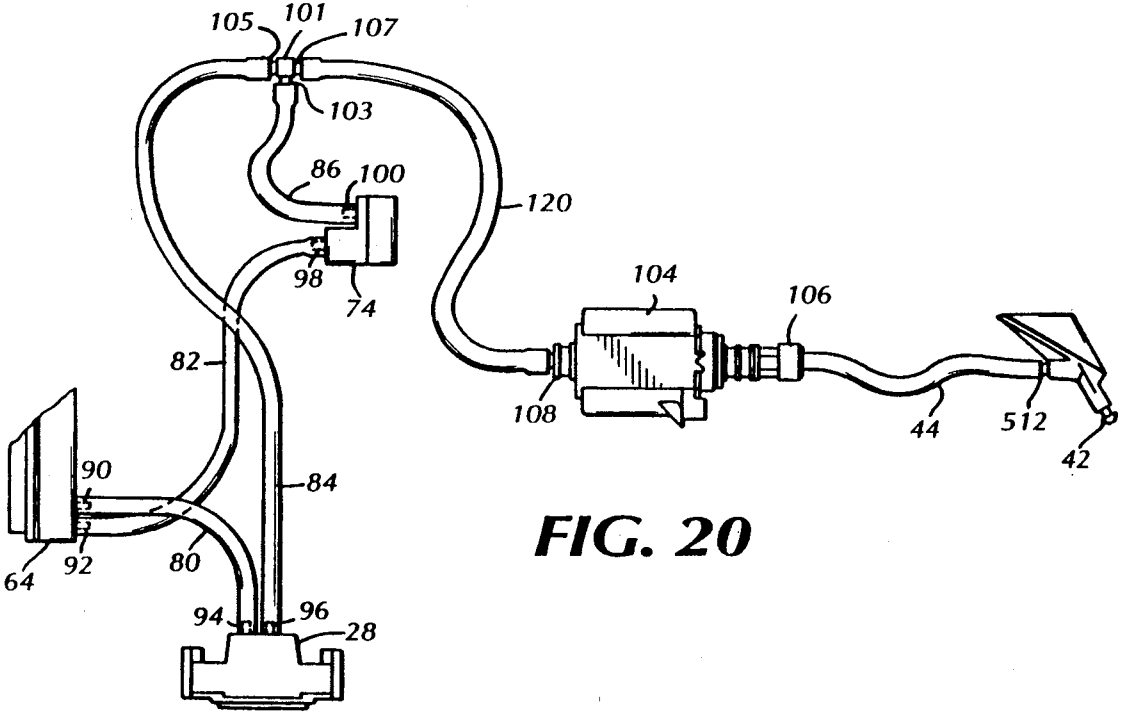
FIG. 20 is a diagram showing a fluid circuit for use with the cleaner of the present invention.

Input connector 108 is connected via pump input conduit 120 to the third connector 107 of "T" connector 101 shown in FIG. 20 (and FIGS. 3 and 4). Pump input conduit 120 has a preferred interior diameter of about 0.187 inches. Pump input connector 120 passes through opening 122 in main frame 17 into rear housing 13, in which "T" connector 101 is located (See FIGS. 3, 4 and 20).

Figure 15:
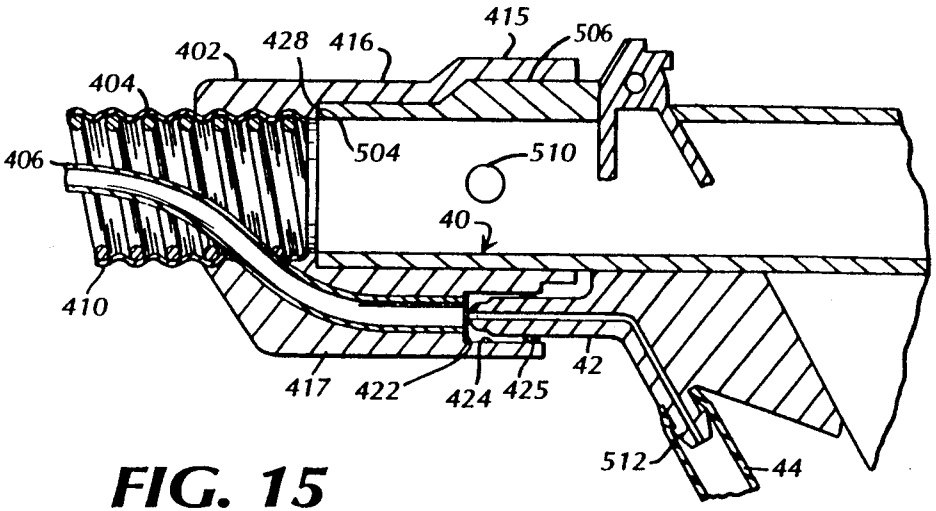
FIG. 15 is a cross-sectional view of the connection between the hose assembly and the cleaner shown in FIGS. 1 and 2.

Output connector 110 is connected via pump output conduit 44 to the input 512 of cleaning solution nipple connector 42, shown in FIG. 15. Pump output conduit 44 has a preferred interior diameter of about 0.156 inches.

The switch 128 for pump 104, which is shown in FIG. 4A, is attached to main frame 17 inside rear housing 13 by conventional means, such as the screws shown in FIG. 4A. Pump switch 128, which is preferably a switch such as part No. DSB-1106-R-DS-02 made by Defond North America, Inc. of Raleigh, North Carolina, is a spring biased momentary contact switch which is normally biased to the "Off" position. Lower handle wire 129 is attached to the switch by a hook 134 in the wire 129 which passes through a hole 138 bored in switch actuator 136. A loop 130 is formed at the other end of lower handle wire 129. Loop 130 protrudes out of rear housing 13 at the recess 132 where handle 14 is joined to main frame 17.

Handle 14 is shown in detail in FIGS. 5 and 5A. Trigger 48 and trigger lock 50 are both pivotally mounted in handle 14 about respective pivots 146 and 148 as shown in FIG. 5. Upper handle wire 144 is attached to trigger 48 at post 145, around which loop 147 is placed (See FIG. 5A). Hook 150 is formed at the other end of upper handle wire 144. When the handle 14 is attached to cleaner 10, hook 150 is connected to loop 130 of lower handle wire 129. Alternatively, a single wire, or any other mechanical actuation means could be used. As shown in FIG. 5, the trigger 48 is locked in the "on" position, with ridge 152 on trigger 48 engaged in indentation 154 formed at the end of trigger lock 50. Because pump switch 128 is spring biased to the "off" position, tension in upper and lower handle wires 144 and 129 forces ridge 152 into indentation 154, which prevents trigger 48 from pivoting counter-clockwise to allow pump switch to be turned off. If trigger 48 is pulled back (clockwise) slightly from the locked position shown in FIG. 5, trigger lock 50 will fall away and hang down, as shown in FIG. 2. Then trigger 48, when released by the user will be urged forward by the tension in upper and lower handle wires 144 and 129 from spring biased pump switch 128, and will return to the "off" position shown in FIG. 2.

Handle halves 149 and 151, which are preferably ultrasonically welded together, are shown separated in the exploded view of FIG. 5A. Handle 14 is joined to main frame 17 by conventional means, such as screws.

The electrical wiring of pump 104 and motor 60 is not shown in detail, as it will be evident to those of ordinary skill in the art. Power switch 54 controls power to the entire cleaner 10, while pump switch 128 controls only pump 104. Thus motor 60 is turned on if switch 54 is "on", while pump 104 is on only if both switches, 54 and 128, are "on". If switch 54 is a three-position switch having two positions in which it is "on", pump 104 is on if switch 54 is in either of its "on" positions and if switch 128 is also "on".

In contrast to the cleaner described in above-incorporated U.S. Pat. No. 4,558,484, the cleaner of the present invention includes one-piece tank unit 34, which is show in FIG. 6. Tank unit 34 includes a top 160 having a circular ridge 162 and an insert 164 therein. Insert 164 includes outer water line nipple connector 166 and an outer bleed line nipple connector 168.

Figure 6:
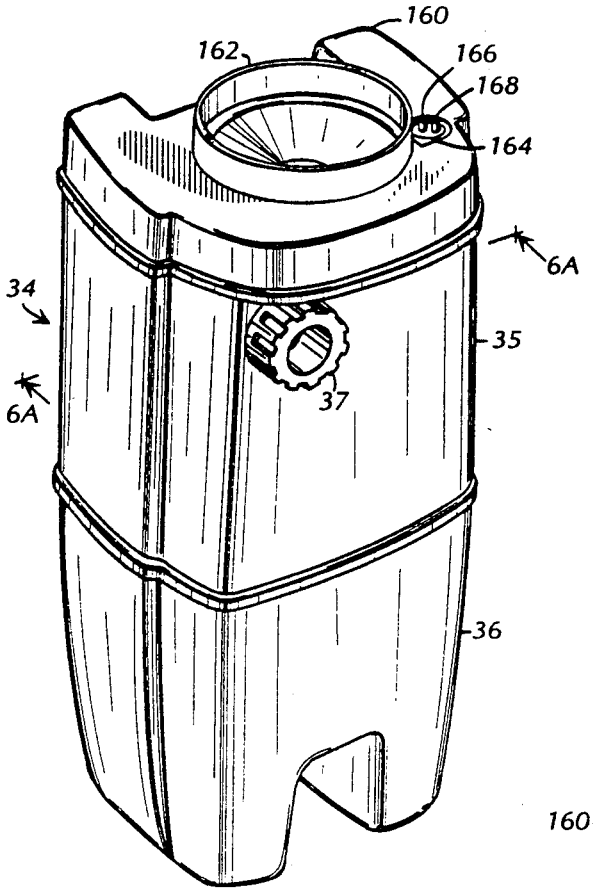
FIG. 6 is a perspective view of the tank unit of the cleaner in accordance with the present invention.
Figure 6A:
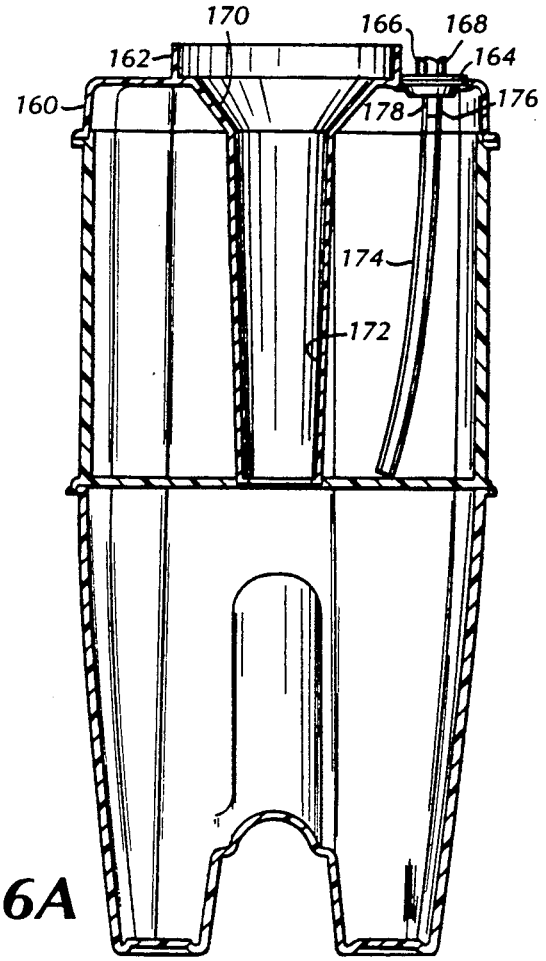
FIG. 6A is cross-sectional view of the tank unit shown in FIG. 6.

As best shown in FIGS. 6 and 6A, the large opening in the top 160 of tank unit 34 leads to dirty solution tank 36 via funnel 170 and conduit 172. Conduit 172 is a circular conduit which passes through middle of clean water tank 35. Water tube 174, which extends to the bottom of clean water tank 35, is connected to inner water line connector 178, so that water can be drawn from clean water tank 35, through insert 164 via a bore (not shown) connecting inner water line connector 178 and outer water line nipple connector 166 into the water port opening of tank block 74 as described in above-incorporated U.S. Pat. No. 4,558,484.

Inner bleed opening 176, which is connected to outer bleed line connector 168 via a second bore in insert 164, permits air from the bleed line port of tank block 74 to enter clean water tank 35 as water is withdrawn via water tube 174. The connection of outer bleed line connector 168 to the bleed line port of tank block 74 is also described in above-incorporated U.S. Pat. No. 4,558,484.

The bottom of separator 32 connects to the top 160 of tank unit 34 as described in above-incorporated U.S. Pat. No. 4,558,484.

Figure 7:
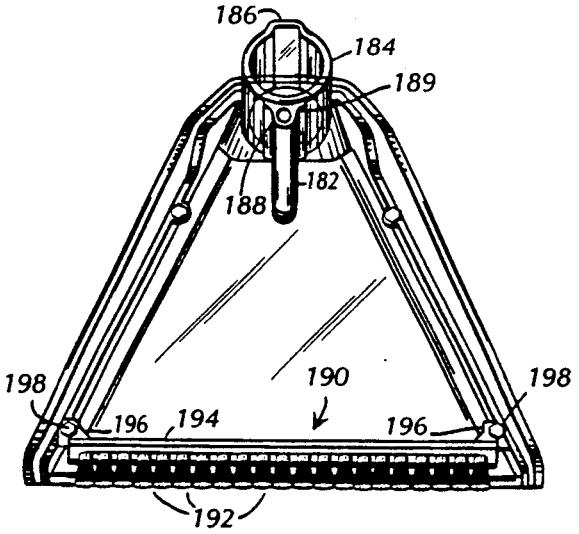
FIG. 7 is a rear view of the floor nozzle shown in FIG. 1.
Figure 7A:
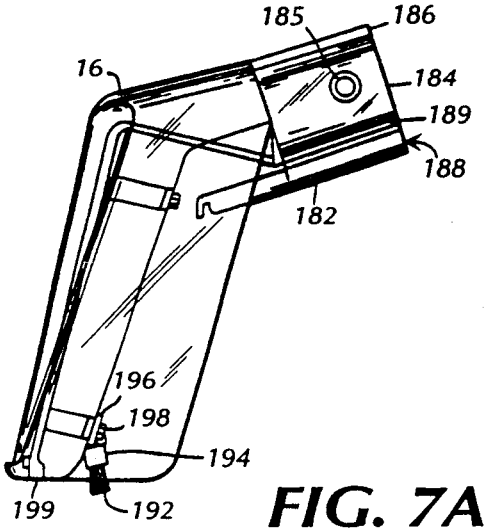
FIG. 7A is a side view of the floor nozzle shown in FIG. 1.

FIGS. 7 and 7A show transparent floor nozzle 16 in accordance with the present invention. Floor nozzle spray tip 182 is mounted to floor nozzle 16 by welding mount 189 by ultrasonically welding mount 189 to the collar 184 of floor nozzle 16. Collar 184 also includes a keyway 186 which conforms to a key 506 on main housing suction connector 40 as shown in FIG. 15. Keyway 186 ensures that collar 184 is properly aligned with main housing suction connector 40 so that cleaning solution nipple connector 42 fits tightly into the bore 188 in the end of floor nozzle spray tip 182, with "O"-ring 425 (shown in FIG. 15) on nipple connector 42 sealing the connection. Collar 184 also includes a circular opening 185 on one side thereof (the right side in FIG. 7, in which opening 185 is not shown). Locking pin 516 of ring lock 514 (shown in FIGS. 16 and 17) fits in opening 185 to lock floor nozzle 16 onto main housing suction connector 40.

Floor nozzle brush 190 comprises bristles 192 which are embedded in brush frame 194. Brush frame 194 includes angled tabs 196 having holes therein so that brush 190 can be mounted to nozzle 16 by screws 198 which are also used to hold the front and back floor nozzle halves together. As shown in FIG. 7A, brush 190 is mounted behind the suction opening 199 formed between the two housing halves.

Figure 8:
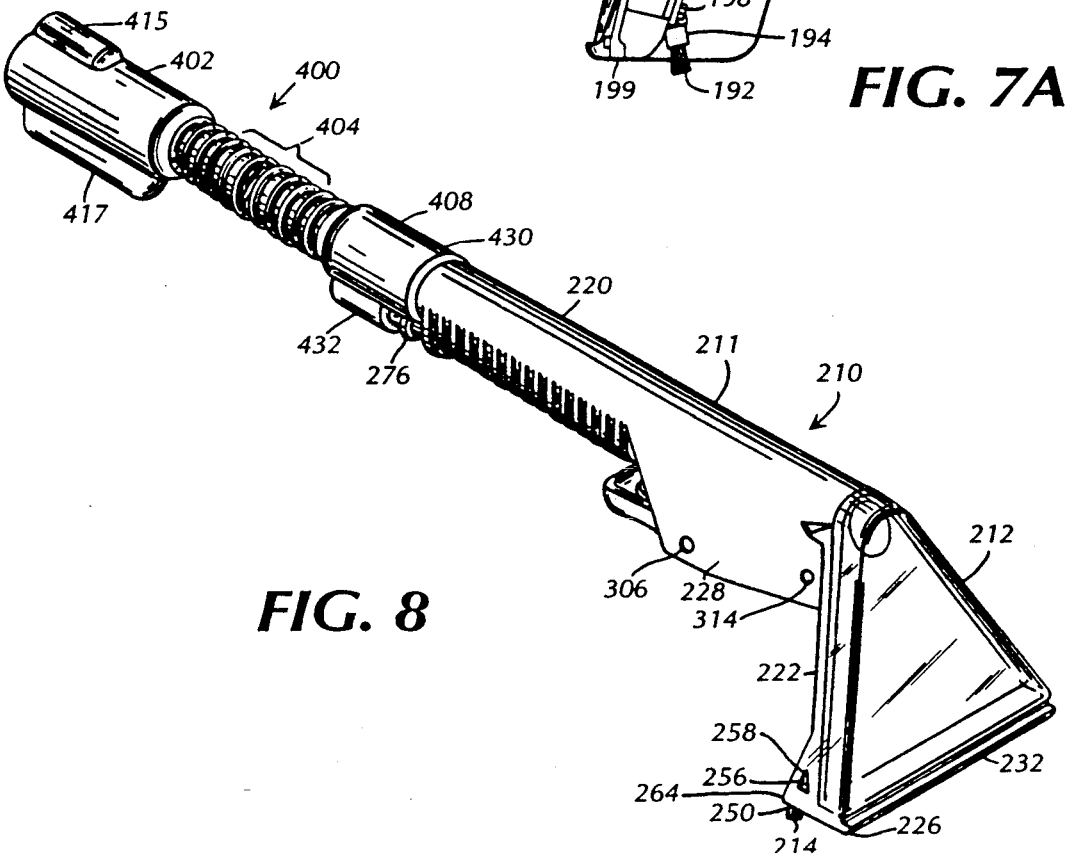
FIG. 8 is a perspective view of a hand tool and hose assembly in accordance with the present invention.
Figure 9:
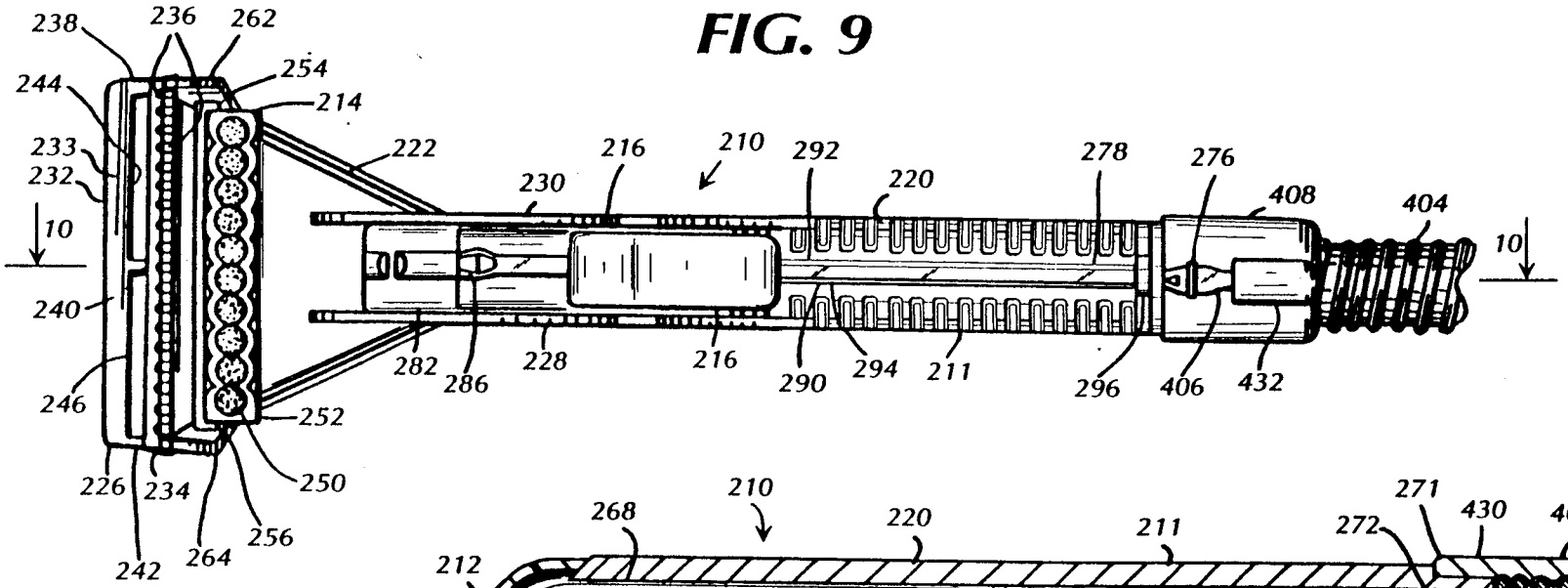
FIG. 9 is bottom view of the hand tool and a portion of hose assembly shown in FIG. 8.
Figure 10:
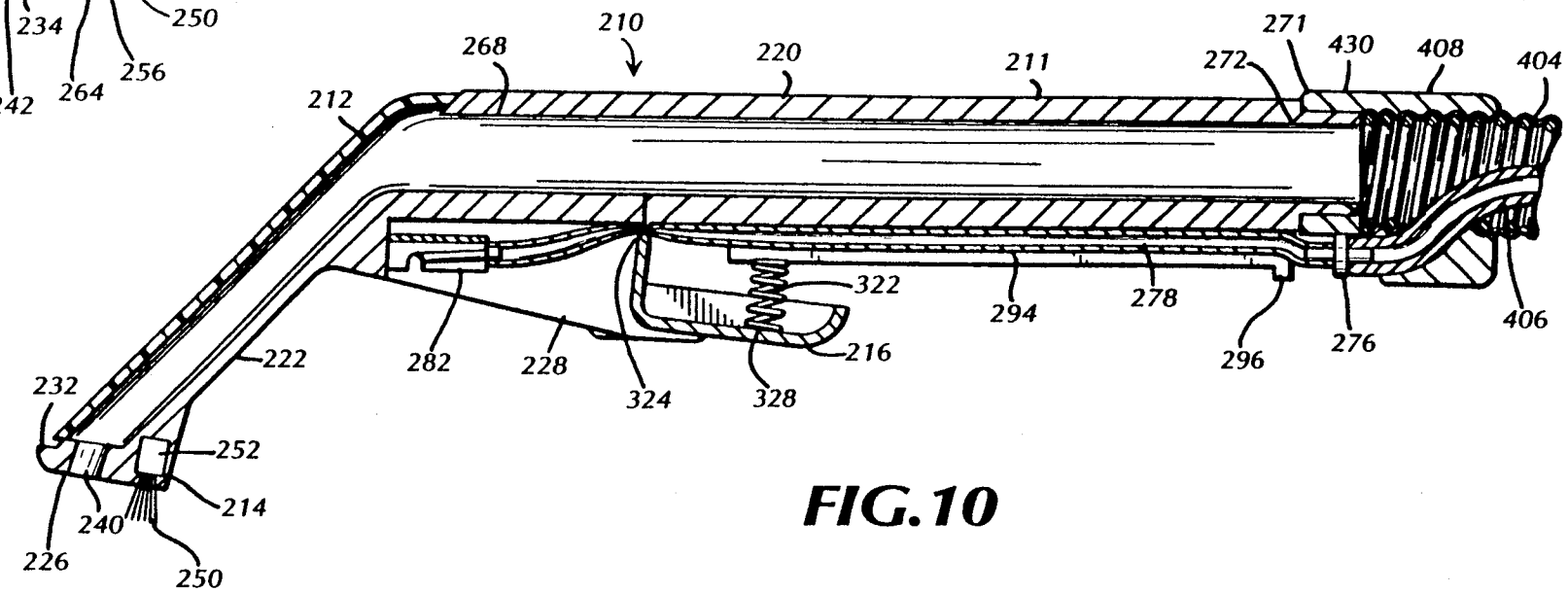
FIG. 10 is a cross-sectional view of the hand tool and a portion of hose assembly shown in FIG. 8.

Hand tool 210 and hose assembly 400, which are shown in FIGS. 8 through 10, will now be described. As will be discussed in more detail below, floor nozzle 16 may be removed from the improved cleaner of the present invention and replaced with hand tool 210 by connecting hose-to-cleaner connector 402 of hose assembly 400 to main housing suction connector 40.

Hand tool 210 includes hand tool housing 211, transparent face plate 212, brush 214 and hand tool trigger 216. Hand tool housing 211 is a single molded component including a generally cylindrical main body 220, a rear nozzle wall 222, a nozzle base 226 and two side walls 228 and 230 which extend down from the sides of the main body 220.

Face plate 212 is ultrasonically welded onto a rear nozzle wall 222 and nozzle base 226 to form the nozzle of hand tool 210. Nozzle base 226 includes a front portion 232 having a flat surface 233 along its bottom and a rear portion 234 having a series of ridges 236 across its bottom. Front and rear portions 232 and 234 are joined along the bottom of hand tool 210 by structural supports 238, 240 and 242. Suction openings 244 and 246 are defined by supports 238, 240 and 242 and front and rear portions 232 and 234.

Brush 214 comprises bristles 250 embedded in brush frame 252. Brush frame 252 includes two ends 254 and 256 having a trapezoidal shape; the ends 254 and 256 of the brush frame 252 are mounted in two similarly shaped openings 258 (only one of which is shown in FIG. 8) in tabs 262 and 264 which extend from rear nozzle wall 222.

Suction conduit 268 extends from the top of the nozzle through hand tool housing 211 and through cylindrical flange 272 which fits into collar 430 of hose-to-hand tool connector 408 of hose assembly 400. Annular wall 271 at the base of circular flange 272 abuts the end of collar 430 of hose-to-hand tool connector 408.

The end of inner (cleaning solution) hose 406 extending out of hose-to-hand tool connector 408 is tightly stretched over one end of tubular connector 276. One end of hand tool pinch tubing 278 is tightly stretched over the other end of tubular connector 276. The other end of hand tool pinch tubing 278 is stretched over the cleaning fluid connector 286 of hand tool spray tip 282. The pinch tubing 278 extending from tubular connector up to about the middle of hand tool trigger 216 is recessed in channel 290 (shown in FIGS. 9 and 11), which is formed by walls 292 and 294. Bridge 296 extends below pinch tubing 278 and channel 290 near tubular connector 276.

Hand tool pinch tubing is preferably 68 durometer Shore A transparent vinyl (PVC) tubing such as part number 01PV121V of Ark-Plas Products, Inc. of Flippin, Ark. or the equivalent.

Figure 11:
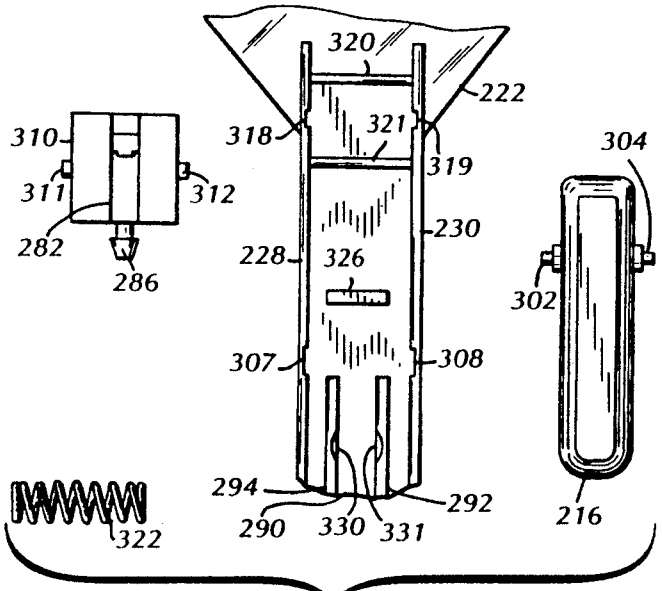
FIG. 11 is a view of a portion of the bottom of the hand tool shown in FIG. 8, with the trigger and spray tip removed.
Figure 12:
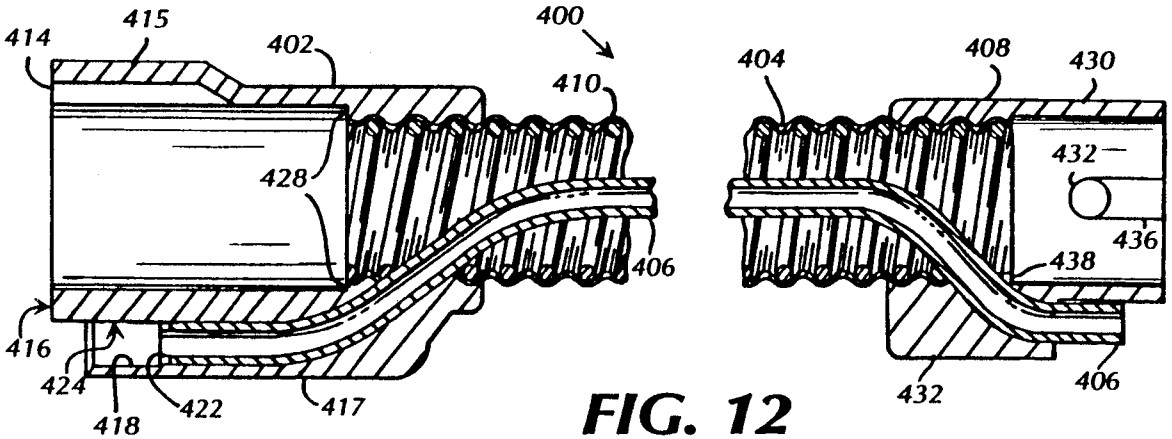
FIG. 12 is a cross-sectional view of the hose assembly shown in FIG. 8.

Hand tool trigger 216 is pivotally mounted beneath hand tool housing 211 by means of pivots 302 and 304, which are best shown in FIG. 11. Pivots 302 and 304 are mounted in openings in side walls 228 and 230; only one of these openings 306 is shown (FIG. 8). Ramped slots 307 and 308 in side walls 228 and 230 permit the pivots to be snapped into these openings.

Hand spray tip 282 which is located below square-shaped mount 310 has tabs 311 and 312 which fit in another set of openings in side walls 228 and 230; only one of these openings 314 is shown (FIG. 8). Ramped slots 318 and 319 in side walls 228 and 230 permit tabs 311 and 312 to be snapped into these openings. When tabs 311 and 312 are set in their respective openings, hand spay tip is prevented from pivoting by ribs 320 and 321 which abut the ends of square-shaped mount 310.

Spring 322 normally biases hammer 324 of hand tool trigger 216 against anvil 326 to crush pinch tubing 278 and thereby prevent any cleaning solution from reaching hand tool spray tip 282. Spring 322 is attached to hand tool trigger 216 by a projection 328 on the inside of the hand tool trigger which may be in the form of a raised cross around which the base of the spring rests. The other end of spring 322 extends slightly into channel 290 in arcuate recesses 330 and 331 in walls 294 and 292, respectively. Recesses 330 and 331 are only about 3/32 of an inch deep—a sufficient depth so as to provide a stable base for spring 322. Spring 322 must be strong enough to allow hammer 324 to hold back the pressure in pinch tubing 278 when pump 104 is turned on.

When the free end of hand tool trigger 216 is pulled toward hand tool housing 211, hammer 324 pivots away from anvil 326 so that pinch tubing 278 is no longer crushed. Pressurized cleaning solution then flows through pinch tubing 278 to hand tool spray tip 282, which sprays the cleaning solution on the surface to be cleaned behind suction openings 244 and 246.

The cleaning solution is under pressure provided that cleaning fluid pump 104 is turned on. In the normal mode of operation, the user locks trigger 48 in handle 14 in the "on" position using trigger lock 50 as described above, after attaching hand tool 210 via hose assembly 400 to main housing suction connector 40 and cleaning solution nipple connector 42. Thus hand tool trigger 216 then controls the flow of cleaning solution to hand tool spray tip 282 by means of the pinch valve formed by hammer 324, anvil 326 and pinch tubing 278.

Pump 104 supplies pressurized cleaning fluid to hand tool spray tip 282 even if hand tool 210 is several feet above cleaner 10. Pump 104 develops a pressure of about 45 psi at its output. Hose assembly 400 is preferably about 7 to 10 feet in length.

Hose assembly 400, which is shown in FIGS. 8–10 and 12–15, will now be described. Hose assembly 400 includes hose-to-cleaner connector 402, hose-to-tool connector 408, suction hose 404 and inner hose 406. Outer suction hose 404 is a reinforced hose of conventional design which is extruded over reinforcing coil 410. Inner hose 406 is embedded in connectors 402 and 408 in a manner known in the art.

Hose-to-cleaner connector 402 includes keyway 414 formed by raised side wall 415, suction coupling collar 416, and cleaning solution passageway 418 formed in a cylindrical portion of hose-to-cleaner connector 402 located below suction collar 416. Annular wall 422 divides passageway 418 into a bore 424 for receiving cleaning solution nipple connector 42 and a passageway for inner hose 406. The side walls of suction coupling collar 416 are not joined directly to suction hose 404, but rather are separated from suction hose 404 by second annular wall 428.

FIG. 15 shows hose-to-cleaner connector 402 joined to main housing suction connector 40 and cleaning solution nipple connector 42. As shown in FIG. 15, suction connector 40 fits inside suction coupling collar 416, with the end wall 504 of suction connector 40 abutting the second annular wall 428 of hose-to-cleaner connector 402. Key 506 fits snugly in keyway 414 formed by raised side wall 415. Cleaning solution nipple connector 42 fits in bore 424, with "O"-ring 425 on nipple connector 42 sealing the connection. Circular opening 510 in suction connector 40 is normally occupied by locking pin 516 of ring lock 514, which is not shown in FIG. 15. A similarly shaped opening (not shown) is cut in suction coupling collar 416 so as to be aligned with opening 510 when suction connector 40 is fitted in hose-to-cleaner connector 402 as shown in FIG. 15. Thus locking pin 516 of ring lock 514 protrudes through opening 510 of suction connector 40 and through the opening (not shown) in hose-to-cleaner connector 402 to lock the coupling together.

Figure 17:
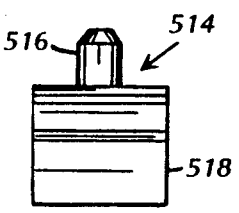
FIG. 17 is a side view of the ring lock in the suction line coupling of the cleaner of the present invention.
Figure 16:
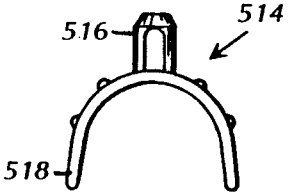
FIG. 16 is a view of the ring lock in the suction line coupling of the cleaner of the present invention.

Ring lock 514, which is shown in FIGS. 16 and 17 comprises a locking pin 516 mounted on a spring base 518. Ring lock 514 is mounted in suction connector 40 so that locking pin 516 is protruding through opening 510 and the curved sides of spring base 518 are in contact with the curved inner walls of suction connector 40. Thus locking pin 516 can be urged inward, back into suction connector 40 to allow the floor nozzle 16 or hose assembly 402 to be put on or removed from connector 40; but once the external pressure on locking pin 516 is removed, resilient spring base 518 biases locking pin 516 outward, back through opening 510.

Hose-to-hand tool connector 408 will now be described. Hose-to-hand tool connector 408 includes collar 430 and a generally cylindrical projection 432, extending below collar 430. Inner hose 406 extends from the inside of suction hose 404 through and out of the end of projection 432, with inner hose 406 ending short of the end of hose-to-hand tool connector 408. Collar 430 includes circular opening 434 at the end of slot 436. Annular wall 438 is located at the inner end of collar 430. As shown in FIG. 10, circular flange 272 of hand tool 210 fits inside collar 430, with the end of flange 272 abutting annular wall 438. As discussed in connection with hand tool 210, inner hose 406 is connected to one end of tubular connector 276.

Circular flange 272 of hand tool 210 includes a circular projection (not shown) which slides in slot 436 and locks in opening 434, to lock hand tool 210 to hose assembly 400.

Figure 18:
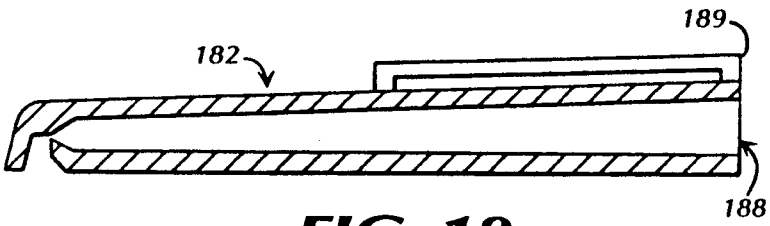
FIG. 18 is a cross-sectional view of the floor nozzle spray tip shown in FIG. 7.
Figure 19:
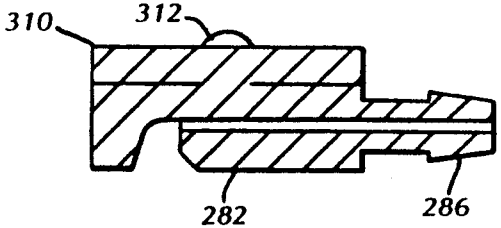
FIG. 19 is a cross-sectional view of the hand tool spray tip shown in FIGS. 9 through 11.
Figure 14:
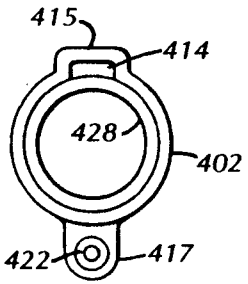
FIG. 14 is an end view of the connector on the hose assembly shown in FIG. 8 which joins the hose assembly to the cleaner shown in FIGS. 1 and 2.
Figure 13:
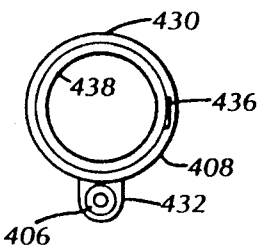
FIG. 13 is an end view of the connector on the hose assembly shown in FIG. 8 which joins the hose assembly to the hand tool.

FIGS. 18 and 19 show cross-sectional views of floor nozzle spray tip 182 and hand tool spray tip 282, respectively.

FIG. 20 shows an overview diagram of the fluid circuit employed in one embodiment of the present invention.

Figure 22:
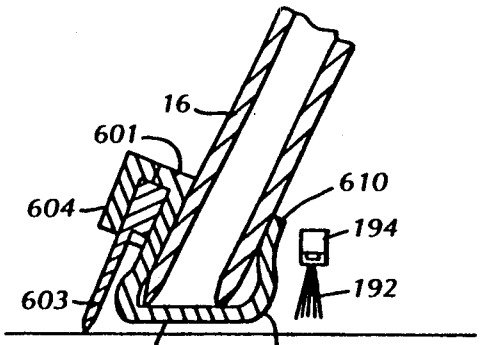
FIG. 22 is a cross-sectional view of the squeegee and squeegee mounting bracket mounted on a vacuum floor nozzle in accordance with the present invention.
Figure 21:
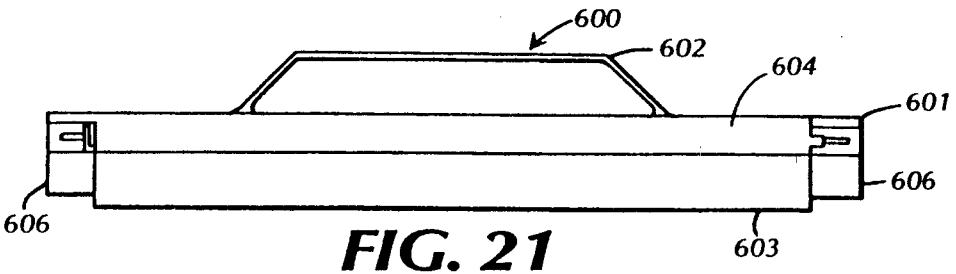
FIG. 21 is a front view of a squeegee and squeegee mounting bracket in accordance with the cleaner of the present invention.

Clip-on squeegee 600 is shown in FIGS. 21 and 22. Clip-on squeegee 600 comprises a rear frame 601 having a handle 602 attached thereto. Squeegee blade 603 is ultrasonically welded between rear frame 601 and front frame 604 as shown in FIG. 22.

Rear frame 601 includes a pair of spring clips 606 at the ends thereof, as shown in FIG. 21. As shown in FIG. 22, spring clips 606 clip on to floor nozzle 16, with the bottom 608 of spring clips 606 covering a portion of the nozzle suction opening. When squeegee 600 is attached to floor nozzle 16, brush 192 is raised slightly off the floor by squeegee blade 603. This prevents fluid on the surface being cleaned from being driven away from the suction opening in floor nozzle 16 by brush 192 when floor nozzle 16 is moved rearwardly.

Spring clips 606 include resilient ends 610 which grasp floor nozzle 16 firmly when squeegee 600 is attached thereto. Squeegee 600 can be easily placed on and removed from floor nozzle 16 by sliding spring clips 606 on and off of floor nozzle 16.

It will be appreciated that the component parts shown herein can be attached by any conventional means. Because the housing components are preferably made of high impact polystyrene plastic, screws are the preferred fastening means.

One skilled in the art will appreciate that the present invention can be practiced by other than the described embodiments, which are presented for the purposes of illustration and not of limitation, and the present invention is limited only by the claims which follow.

What is claimed is:

1. A cleaning system of the type which applies a cleaning fluid to a surface to be cleaned and subsequently vacuums dirty cleaning fluid from the surface, said system comprising:

a main cleaner unit comprising a cleaning fluid pump, cleaning fluid supply means, first fluid conduit means for connecting said cleaning fluid supply means to an inlet of said cleaning fluid pump, switch means for selectively activating said pump, main cleaner unit actuator means for actuating said switch means, and second fluid conduit means for directing cleaning fluid output from a cleaning fluid nipple connector, said main cleaner unit further comprising an air/liquid separator and a blower attached thereto, a motor for driving said blower, said blower drawing air and dirty fluid from a first end of a suction conduit into said air/liquid separator, said separator separating the air from the dirty cleaning fluid and exhausting said air through an exhaust conduit and funneling said dirty cleaning fluid to a dirty cleaning fluid storage tank, a second end of said suction conduit terminating in a generally cylindrical flange, said cylindrical flange extending parallel to said cleaning fluid nipple connector, a floor nozzle including a first spray nozzle for spraying said cleaning solution onto the floor, said first spray nozzle having a bore therein for connecting said first spray nozzle to said cleaning fluid nipple connector, said floor nozzle further comprising a suction passageway leading from a suction opening to a coupling collar, spraying means affixed to said coupling collar, whereby said coupling collar detachably connects to said cylindrical flange of said main cleaner unit suction conduit with said cleaning fluid nipple connector detachably fitting in said bore of said first spray nozzle;

a hand tool including a second spray nozzle for applying cleaning fluid to a surface to be cleaned, a third fluid conduit means for supplying said second spray nozzle with cleaning fluid, valve means for controlling the flow of cleaning fluid in said third fluid conduit means, and hand tool actuator means for actuating said valve means, said hand tool further comprising a suction nozzle and attachment means for detachably connecting both said suction nozzle and said third fluid conduit of said hand tool to said cylindrical flange of said main cleaner unit suction conduit and said cleaning fluid nipple connector, respectively, whereby said hand tool may be attached to said main unit suction conduit and main unit cleaning fluid nipple connector when said floor nozzle is detached therefrom; and means for selectively locking said main cleaner unit actuator means in a position so that said pump remains on, whereby said hand tool actuator means actuates said valve means to control the application of cleaning fluid to the surface to be cleaned when said hand tool is attached to said main cleaner unit.

2. The cleaning system of claim 1, wherein said main cleaner unit actuator means and said means for selectively locking said main cleaner unit actuator means are located on a handle portion of said main cleaner unit.

3. The system of claim 2, wherein said switch means comprises an electric contact which is spring biased to a position which removes power form said cleaning fluid pump.

4. The system of claim 3, wherein said main cleaner unit actuator means in said handle comprises a trigger linked to said switch means by a mechanical linkage.

5. The cleaning system of claim 1, wherein said cleaning fluid supply means comprises a container for holding concentrated cleaning fluid, a tank for holding water and fluid conduits connecting said container and said water tank to first and second inputs to mixing manifold means, said mixing manifold means having an output connected to said first fluid conduit means for supplying said cleaning fluid to said pump, whereby said pump draws water from said water tank and concentrated cleaning fluid from said container and mixes said water and said concentrated cleaning fluid in said mixing manifold means to form said cleaning fluid.

6. The system of claim 5 wherein said mixing manifold means comprises a T-shaped fluid connector.

7. The system of claim 6 wherein said tank for holding water and said dirty cleaning fluid storage tank form an integral tank assembly unit which is detachable from said main cleaner unit.

8. The system of claim 1 wherein said main cleaner unit further comprises a pair of wheels mounted to said unit by a pair of struts and a cleaner unit stand which, with said pair of wheels supports said main cleaner unit when said floor nozzle has been removed from said main cleaner unit, said stand being raised off the floor when said floor nozzle is attached to said main cleaner unit.

9. The system of claim 1, wherein said system further comprises a spring biased locking pin in said cylindrical flange of said main cleaner unit, said locking pin extending through an opening in said cylindrical flange.

10. The system of claim 9, wherein said coupling collar of said floor nozzle further includes an opening for receiving said locking pin to lock said floor nozzle onto said main cleaner unit.

11. The system of claim 9, wherein said hand tool attachment means comprises a hose assembly, said hose assembly comprising an inner cleaning fluid hose within an outer suction hose.

12. The system of claim 11, wherein said suction hose includes reinforcing coils.

13. The system of claim 12, wherein said hose assembly further comprises a connector for connecting said hose assembly to said cylindrical flange and said nipple connector of said main cleaner unit, said connector of said hose assembly including an opening for receiving said locking pin to lock said connector of said hose assembly onto said main cleaner unit.

* * * * *